US009102340B2

(12) United States Patent
Tresanini et al.

(10) Patent No.: US 9,102,340 B2
(45) Date of Patent: Aug. 11, 2015

(54) RAILWAY CIRCUIT FOR SENDING SIGNALLING INFORMATION ALONG A RAILWAY LINE TO A VEHICLE TRAVELLING ALONG THE RAILWAY LINE

(71) Applicant: Ansaldo STS S.p.A., Genoa (IT)

(72) Inventors: Renzo Tresanini, Genoa (IT); Marco Ruscelli, Genoa (IT); Paolo Spiga, Genoa (IT)

(73) Assignee: ANSALDO STS S.P.A., Genoa (IT)

( * ) Notice: Subject to any disclaimer, the term of this patent is extended or adjusted under 35 U.S.C. 154(b) by 27 days.

(21) Appl. No.: 13/957,582

(22) Filed: Aug. 2, 2013

(65) Prior Publication Data

US 2014/0124628 A1 May 8, 2014

(30) Foreign Application Priority Data

Aug. 2, 2012 (IT) ..... TO2012A0695

(51) Int. Cl.
*B61L 1/18* (2006.01)
*B61L 3/24* (2006.01)

(52) U.S. Cl.
CPC *B61L 1/188* (2013.01); *B61L 3/246* (2013.01)

(58) Field of Classification Search
CPC ..... B60L 1/188; B60L 3/246; B60L 1/187; B60L 3/00; B60L 3/24; B60L 3/221; B60L 25/025; B60L 23/22
USPC ..... 246/193, 194, 196
See application file for complete search history.

(56) References Cited

U.S. PATENT DOCUMENTS

| | | | | | |
|---|---|---|---|---|---|
| 5,263,670 | A | * | 11/1993 | Colbaugh et al. | 246/63 R |
| 5,523,753 | A | * | 6/1996 | Fedde et al. | 340/933 |
| 5,720,454 | A | * | 2/1998 | Bachetti et al. | 246/34 R |
| 5,734,338 | A | * | 3/1998 | Hoekman et al. | 340/941 |
| 5,936,551 | A | * | 8/1999 | Allen et al. | 340/941 |
| 6,087,964 | A | * | 7/2000 | Allen et al. | 340/941 |
| 6,226,575 | B1 | * | 5/2001 | Lu et al. | 701/31.9 |
| 6,281,809 | B1 | * | 8/2001 | Potter, Sr. | 340/933 |
| 6,527,230 | B1 | * | 3/2003 | Frick | 246/194 |
| 6,781,524 | B1 | * | 8/2004 | Clark et al. | 340/933 |

(Continued)

FOREIGN PATENT DOCUMENTS

| | | |
|---|---|---|
| EP | 0 771 711 | 5/1997 |
| NL | 1 026 709 C2 | 1/2006 |

OTHER PUBLICATIONS

Search Report from the Italian Patent Office dated May 29, 2013 in Italian Patent Application No. TO20120695.

*Primary Examiner* — Jason C Smith
(74) *Attorney, Agent, or Firm* — Dorsey & Whitney LLP

(57) ABSTRACT

A railway circuit for detecting the free or occupied state of the same and for sending signalling information along a railway line to a vehicle travelling along said railway line. A signal generator generates a signal with varying current modulated with FSK technique on a basis of a modulation code. The signal is supplied to a coil magnetically coupled with first and second rails that constitute the single railway circuit to induce a variable current modulated by the code on the electric circuit formed by the portions of the first and second rail short-circuited alternatively by the electric joint. The vehicle is provided with a current sensor suitable for detecting the variable current for extraction of the code and sending the signal to the driver. A signal generator generates a signal in compliance with new safety requirements to determine, with the receiver, the free/occupied state of the railway circuit.

7 Claims, 1 Drawing Sheet

(56) References Cited

U.S. PATENT DOCUMENTS

2003/0112131 A1* 6/2003 McAllister ..... 340/425.5
2011/0011985 A1* 1/2011 Hogan ..... 246/34 R
2011/0147535 A1* 6/2011 Aisa et al. ..... 246/122 R
2011/0284697 A1* 11/2011 Altamura et al. ..... 246/4
2011/0309204 A1* 12/2011 Bohlmann et al. ..... 246/122 R
2011/0315828 A1* 12/2011 Bohlmann et al. ..... 246/167 R
2013/0015296 A1* 1/2013 Maurizio et al. ..... 246/122 R
2014/0012438 A1* 1/2014 Shoppa et al. ..... 701/19
2014/0014783 A1* 1/2014 Lude et al. ..... 246/122 R
2014/0103167 A1* 4/2014 Bohlmann et al. ..... 246/62
2014/0124628 A1* 5/2014 Tresanini et al. ..... 246/194

* cited by examiner

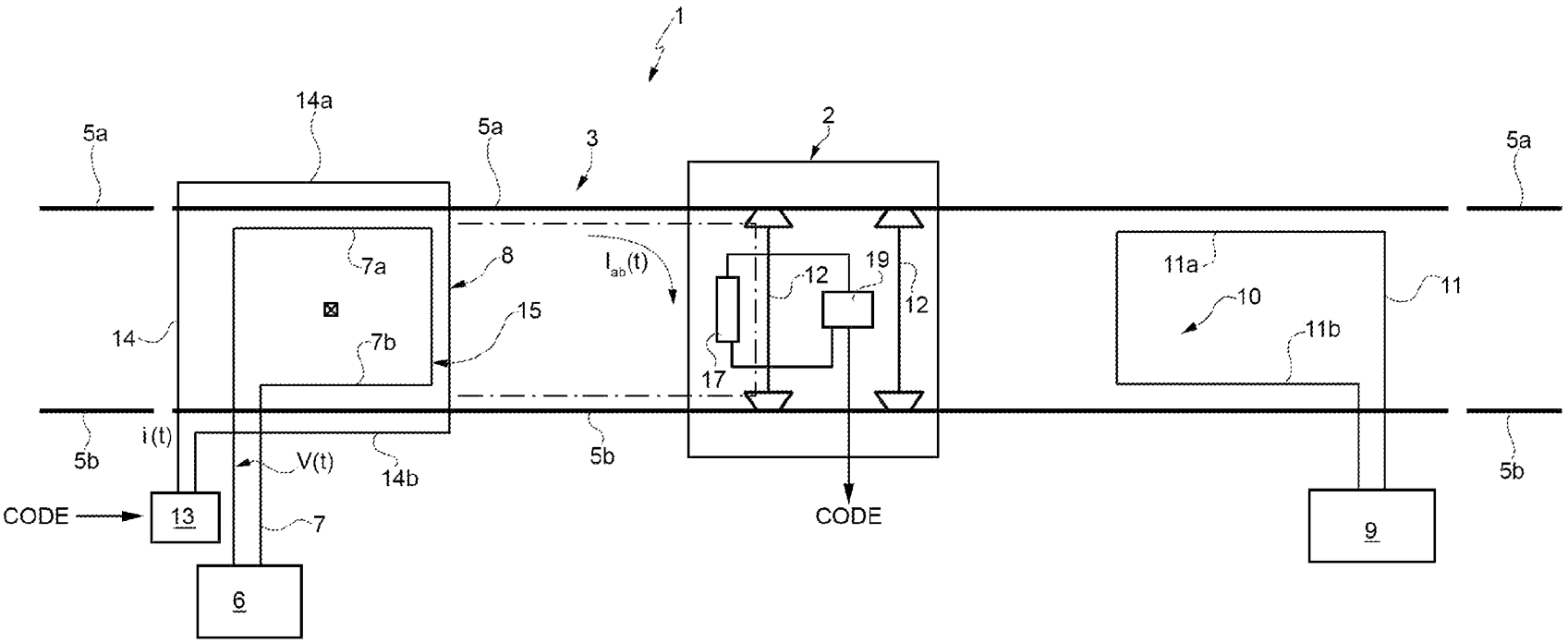
1
2
3
5a
5b
7
7a
7b
8
9
10
11
11a
11b
12
13
14
14a
14b
15
17
19
CODE
CODE
V(t)
i(t)
$I_{ab}(t)$

RAILWAY CIRCUIT FOR SENDING SIGNALLING INFORMATION ALONG A RAILWAY LINE TO A VEHICLE TRAVELLING ALONG THE RAILWAY LINE

TECHNICAL FIELD

At least one embodiment of the present invention concerns a railway circuit suitable for sending signalling information along a railway line to a vehicle travelling along the railway line.

BACKGROUND

Railway circuits are known for detecting the presence of a vehicle travelling along the railway line comprising:

a first signal generator suitable for generating an alternating signal V(t) with varying voltage supplied to a first conductor which comprises rectilinear sections arranged adjacent to respective portions of a first and a second rail to define at least a first square coil magnetically coupled with the first and the second rail;

a signal receiver suitable for receiving the alternating signal V(t) present on the railway by means of a second square coil comprising a second conductor which comprises rectilinear sections arranged adjacent to respective portions of the first and second rail and magnetically coupled to the rails; the signal receiver is suitable for discriminating between two states:

a condition of signal received above a threshold in which the rails are not short-circuited by an axle of the vehicle and the railway circuit is considered free; and a condition of signal received below a threshold or null in which the rails are short-circuited by at least one axle of a railway vehicle present on the railway and the railway circuit is considered occupied.

A railway circuit of the type described above can be—for example—equipped using the devices P-1400 of the company Railroad Control Limited in accordance with U.S. Pat. Nos. 5,936,551; 6,087,964; 6,226,575; and 6,281,809.

SUMMARY

The object of at least one embodiment of the present invention is to use a railway circuit of the type described above or analogous for the transmission of further information along the railway line.

The above object is achieved by at least one embodiment of the present invention which relates to a railway circuit suitable for sending signalling information along a railway line to a vehicle travelling along the railway line comprising:

first signal generator means suitable for generating an alternating signal V(t) with varying voltage supplied to a first conductor which comprises sections arranged adjacent to and within respective portions of a first and a second rail facing towards the inside and belonging to a railway circuit to define at least a first coil magnetically coupled with the first and the second rail;

signal receiver means suitable for receiving said alternating signal V(t) present on said railway circuit by means of a second coil in which a second conductor comprises sections arranged adjacent to respective portions of the first and second rail and magnetically coupled with said rails; the signal receiver means being suitable for detecting a condition of signal received null or below a threshold when said rails are short-circuited by at least one axle of a railway vehicle present on said railway circuit, characterised in that it comprises second signal generator means suitable for generating a signal I(t) with varying current on the basis of a modulation code (CODE) associated with said signalling information; said signal I(t) being supplied to a third conductor which comprises sections arranged adjacent to respective portions of the first and second rail facing towards the outside to define at least a third coil coaxial and external to the first and magnetically coupled with the first and second rail; said second signal generator means being suitable for inducing on the electric circuit formed by the portions of the first and second rail short-circuited by said axle a variable current Iab(t) modulated by said code; said railway vehicle being provided with current detector means suitable for detecting said variable current Iab(t) for extraction of said code (CODE) and sending of said signalling information.

BRIEF DESCRIPTION OF THE DRAWING

The invention will be illustrated with reference to the attached drawing which represents—in a schematic manner—a non-limiting embodiment.

DETAILED DESCRIPTION

In the attached FIGURE the number 1 indicates, as a whole, a railway circuit for sending signals along a railway line 3 to a vehicle 2 (illustrated schematically—for example an electric locomotive) travelling along the railway line 3.

The railway line 3 comprises a plurality of pairs of rails 5*a*,5*b* electrically connected to one another by means of respective electrical joints (of known type); consecutive pairs of rails (each pair of rails defines a respective railway circuit) are functionally separated from one another by the electrical joint.

The railway circuit 1 comprises:

a first signal generator 6 (of known type) suitable for generating an alternating signal V(t) (typically a signal with frequency in the range 3.5+16.5 kHz and voltage in the maximum range of 10 Veff) with varying voltage supplied to a first conductor 7 which comprises rectilinear sections 7*a*, 7*b* arranged adjacent to respective first end portions of the first and second rail 5*a*, 5*b* facing towards the inside to define at least a first square coil 8 magnetically coupled with the first and the second rail 5*a*,5*b*; and a signal receiver 9 suitable for receiving the alternating signal V(t) present on the rail by means of a second square coil 10 comprising a second conductor 11 which comprises rectilinear sections 11*a*, 11*b* arranged adjacent to respective second end portions of the first and second rail 5*a*, 5*b* and magnetically coupled with the rails 5*a*,5*b*.

The rectilinear sections 7*a*, 7*b* and 11*a*, 11*b* are arranged adjacent to respective internal facing portions of the rails 5*a*, 5*b* so that the track of the square coils 8 and 10 lies within the area delimited by the tracks of the rails 5*a*, 5*b*.

The signal receiver 9 is suitable for discriminating between two states:

a condition of signal received above a threshold in which the rails 5*a*, 5*b* are not short-circuited by an axle of the vehicle and the railway circuit is considered free (i.e. no vehicle is present);

a condition of signal received below a threshold or null in which the rails 5*a*, 5*b* are short-circuited by at least one metallic axle 12 of the railway vehicle 2 and the railway circuit is considered occupied.

According to an embodiment of the present invention, the railway circuit 1 comprises a second signal generator 13 (also of known type and illustrated schematically) suitable for generating a signal I(t) with varying current on the basis of a modulation code CODE associated with a signal to be transmitted to the vehicle 2. Typically the signal relates to the state of the railway circuits subsequent to the one in which the vehicle 2 is located.

The signal I(t) is supplied to a third conductor 14 which comprises rectilinear sections 14*a*, 14*b* arranged adjacent and external to respective portions of the first and second rail 5*a*, 5*b* to define at least a third coil 15 coaxial to the first coil 8 (the track of the axle is indicated by 16) and magnetically couple with the first and the second rail 5*a*,5*b*.

The second signal generator 13 is suitable for inducing on the electric circuit formed by the portions of the first and second rail 5*a*, 5*b* (said portions are indicated by the dot and dash line), short-circuited by the axle 12, a variable current Iab(t) modulated by the code CODE.

The railway vehicle 2 is provided with at least one current sensor 17 suitable for detecting the variable current Iab(t) and emitting an output signal which is sent to an electronic control unit 19 (shown schematically) present on the railway vehicle 2 and used for extraction of the code CODE and supply of the relative signal to the driver (not illustrated) of the railway vehicle.

The rectilinear sections 14*a*, 14*b* are arranged adjacent to respective opposite external portions of the rails 5*a*, 5*b* so that the track of the square coil 15 overshoots the area delimited by the tracks of the rails 5*a*,5*b*.

Consequently, in plan view, the first coil 8 is internal with respect to the third coil 15 and the rail 5*a* (5*b*) is interposed respectively between the rectilinear section 14*a* (14*b*) of said first coil 8 and the rectilinear section 7*a* (7*b*) of said coil 15. This arrangement (the sections 14*a*/7*a* and 14*b*/7*b* are arranged on opposite sides of the respective rails 5*a*, 5*b* alongside which they are positioned) introduces an effective magnetic shielding between the first coil 8 which is internal with respect to the third external coil 15 and allows the independent operation of these two coils, minimising the magnetic coupling.

Expediently, the third coil 15 can be provided on railway circuits which already have the first coil 8 and the second coil 10 so as to integrate an existing railway circuit with new functions to, thus, allow updating of a railway line to new safety requirements which entail the transmission of a code, maintaining unchanged the installations and equipment on board the railway vehicle which operate with the existing railway circuits.

Moreover the second signal generator 13 is suitable for modulating the signal I(t) by means of Frequency-Shift-Keying technology. The frequency of the signal I(t) is different from the frequency of the signal V(t).

As is known, frequency-shift keying (FSK) is a numerical frequency modulation technique or scheme, in which the modulating signal containing information (in this case the bits of the CODE code) shifts the frequency of the output carrier from one to another of two pre-determined frequency values.

On the basis of the above, the following architecture is created:

the coil 15 is arranged on the outside of the perimeter of the first coil 8 with the rectilinear sections 14*a*, 14*b* facing the outer side of the rails 5*a*, 5*b* and the rectilinear sections 7*a*, 7*b* facing the inner side of the rails 5*a*, 5*b*.

On the basis of the tests performed by the inventors, said arrangement minimises the interferences between the coils 8 and 15 and ensures that the operation of each of the two coils in question (used for performing distinct independent safety functions) does not substantially influence that of the other, also in the event of failures on one of the two coils.

The railway circuit could have a fourth coil (not illustrated) with analogous structure and function to that of the third coil 15 and therefore supplied by a signal generator analogous to the signal generator 13. Said fourth coil would be coaxial to the second coil 10 providing a symmetrical system for the transmission of data to the vehicle 2 independently of its direction of forward movement, since the third coil 15 and the fourth coil would be used with the function of transmission and reception respectively (or vice versa) according to the direction of movement of the vehicle 2.

In the event of the railway circuit being free, the third and fourth coil could be used respectively for transmission (reception) and reception (transmission) of the signal I(t) in order to test the railway circuit and all the connections relative to said third and fourth coils and relative transmission and reception systems.

The invention claimed is:

1. A railway circuit for sending signalling information along a railway line to a vehicle travelling along the railway line, the railway circuit comprising:

first signal generator means suitable for generating an alternating signal with a varying voltage supplied to a first conductor that comprises sections arranged adjacent to and within respective portions of a first and a second rail facing towards the inside and belonging to a railway circuit to define at least an inner first coil magnetically coupled with the first and the second rail;

signal receiver means suitable for receiving said alternating signal present on said railway circuit by means of a second coil, wherein a second conductor comprises sections arranged adjacent to respective inner portions of the first and second rail and magnetically coupled with said rails, the signal receiver means being suitable to detect a condition of signal received null or below a threshold when said rails are short-circuited by at least one axle of a railway vehicle present on said railway circuit; and second signal generator means suitable for generating a signal with variable current on the basis of a modulation code associated with said signalling information; said signal being supplied to a third conductor which comprises sections arranged adjacent to respective outer portions of the first and the second rail facing towards the outside to define at least an outer third coil coaxial and external to the inner first coil and magnetically coupled with the first and the second rail;

wherein said second signal generator means being suitable to induce on the electric circuit, formed by the portions of the first and the second rail short-circuited by said axle, a variable current modulated by said code; said railway vehicle being provided with current detector means suitable for detecting said variable current for extraction of said code and sending of said signalling information.

2. The railway circuit as claimed in claim 1, wherein said second signal generators are suitable for modulating said signal by means of Frequency-Shift-Keying technology.

3. The railway circuit as claimed in claim 1, wherein, in plan view, said third coil is external to said first coil.

4. The railway circuit as claimed in claim 1, wherein said first and said third coil have in plan view a rectangular perimeter.

5. The railway circuit as claimed in claim 1, wherein said second coil has in plan view a rectangular perimeter.

6. The railway circuit as claimed in claim 1 wherein, in plan view, the sections of said first coil are internal with respect to the sections of rail of the railway circuit.

7. The railway circuit as claimed in claim 1 wherein, in plan view, the sections of said third coil are external with respect to the sections of rail of the railway circuit.

* * * * *